US006257142B1

(12) United States Patent
Baba

(10) Patent No.: US 6,257,142 B1
(45) Date of Patent: Jul. 10, 2001

(54) ROTARY PRINTING PRESS FOR PRODUCTION OF MULTIPLE CENTER SPREAD SIGNATURES

(75) Inventor: Takayuki Baba, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/455,507

(22) Filed: Dec. 6, 1999

(30) Foreign Application Priority Data

Dec. 25, 1998 (JP) ..... 10-369572

(51) Int. Cl.[7] ..... B41F 1/34; B41F 5/16; B41F 13/56; B41F 13/64; B65H 39/16

(52) U.S. Cl. ..... 101/480; 101/181; 101/224; 101/226; 101/228; 101/232; 101/240; 270/4; 270/5.01; 270/5.02; 270/20.1; 270/52.17

(58) Field of Search ..... 270/5.01, 5.02, 270/52.07, 52.09, 52.17, 4, 20.1, 21.1; 101/219, 220, 224–228, 480, 181, 240, 232

(56) References Cited

U.S. PATENT DOCUMENTS

| | | | | |
|---|---|---|---|---|
| 2,003,639 | * | 6/1935 | Wood | 270/5 |
| 2,050,031 | * | 8/1936 | Wood | 270/5 |
| 3,582,111 | * | 6/1971 | Siiter | 283/56 |
| 3,697,061 | * | 10/1972 | Levine et al. | 270/5 |
| 3,899,381 | * | 8/1975 | O'Brien et al. | 156/204 |
| 4,305,605 | * | 12/1981 | Vine | 281/35 |
| 4,997,205 | * | 3/1991 | Hansch | 281/2 |
| 5,320,334 | * | 6/1994 | DeAngelis | 270/4 |
| 5,547,225 | * | 8/1996 | DeAngelis | 281/211 |
| 6,029,968 | * | 2/2000 | Honegger | 270/37 |

FOREIGN PATENT DOCUMENTS 58-87748 6/1983 (JP) .

10-29387 2/1998 (JP) .

OTHER PUBLICATIONS

Patent Abstracts of Japan, Inventor: Sasamoto Yoshibumi; "Newspaper Having Double–Spread Face at Plurality of Places, Production Thereof, and Apparatus Therefor"; publication date: Feb. 3, 1998.

Patent Abstracts of Japan, Inventor: Obara Isao; Folding Device of Rotary Press Printer publication date: Aug. 27, 1986.

"Development of Double Center Spread Systems," 1997–1 issue, No. 159, pp. 78–81, Japan Newspaper Association, Mar. 25, 1997.

* cited by examiner

*Primary Examiner*—Kimberly Asher
(74) *Attorney, Agent, or Firm*—Arent Fox Kintner Plotkin & Kahn, PLLC

(57) ABSTRACT

Several printing units are arranged in a row for printing on as many separate webs traveling in centerline alignment and in phase with one another. At least one preselected web, on issuing from one printing unit, is directed over an angled guide rod thereby to be turned 90 degrees out of phase with the other, unselected webs. Subsequently traveling over a triangular shaped former, the preselected web is folded along a centerline thereof, back into phase with the unselected webs. The preselected web, already formed, and the unselected ones, yet unfolded, are then all superposed one upon another, with the fold of the preselected web in register with the aligned centerline of the unselected webs. The superposed webs are then folded by another former along the aligned centerline of the unselected webs. Subsequently fed into a cutting and folding device, the webs are cut and folded transversely into individual multiple-page signatures each having one center spread in addition to the usual inmost center spread. The additional center spread may be inserted between any two pages on either side of the centerline folds of each signature. Additional embodiments are disclosed for creating two or three additional center spreads.

10 Claims, 19 Drawing Sheets

ROTARY PRINTING PRESS FOR PRODUCTION OF MULTIPLE CENTER SPREAD SIGNATURES

BACKGROUND OF THE INVENTION

This invention relates to printing presses in general and, in particular, to a web-fed rotary printing press capable of producing multiple-page signatures or sections each including two or more "center spreads," by which term is meant the sheets of paper or other printable material each bearing a pair of facing pages, irrespective of the presence or absence of columnar division between the pages, of the matter printed thereon, or of the positions of these sheets relative to the other sheets of the signature.

The rotary printing press has been known and used extensively in which a plurality of webs from separate stocks or rolls are concurrently printed upon, superposed one on top of another, fed through a device that gives them their down-the-middle fold, and cut into individual sheets. There are thus obtained signatures each consisting of a predetermined number of pages in consecutive order. Produced in this familiar manner, however, each signature has only one center spread, only one paper bearing two center facing pages in the inmost position of the folded signature.

Attempts have been made in recent years at production of signatures each having two or more center spreads. Japanese Unexamined Patent Publication No. 10-29387 represents one conventional approach to this objective, teaching a web-fed rotary printing press designed explicitly for production of multiple-center-spread newspapers. This prior art apparatus comprises a slitter for cutting the web along its centerline into a pair of web halves, a first triangular shaped former for folding a first web half down the middle, a second similar former for similarly folding a second web half, and guide means for directing the folded first web half, which is to form additional center-spreads, between the desired pages of the multiple-page sections formed from the second web halves.

To dwell a bit more on this prior art apparatus, the two formers are oriented in the same direction along the paths of the web halves just downstream of the slitter. Consequently, the first web half, which is to form folded additional center spreads, lies, on being folded by the first former, in a plane that is displaced 90 degrees from that of the second web half traveling toward the second former; that is, the first web half is then at 90 degrees out of phase with the second. An angled guide bar (turning bar) and guide rollers are therefore provided between the two formers in order to correct the 90-degree phase displacement of the first web half, bringing the same back into phase with the second web half and further aligning the fold of the first web half with the centerline of the second web half. Then, with the first web half superposed on the second, both web halves are guided to the second former. The thus folded web halves are subsequently cut and folded transversely, into signatures including the additional center spreads.

It is stated in the specification of the noted unexamined patent publication that another additional former may be provided to insert another additional center spread into each signature. It is also said that the production of multiple-center-spread signatures of very large numbers of pages is possible by adding angle guide bars and associated rollers.

An objection to this prior art contrivance concerns in particular the angled guide bar between the two formers. Since these formers are oriented in the same direction, the interposition of the angled guide bar between the formers is a requisite to return the first web half, which has been turned 90 degrees in phase on being folded by the first former, back into phase with the second web half before they come to the second former. Essentially in the form of a fixed rod, the guide bar has introduced considerable friction to the web half. The consequences of such friction have been especially inconvenient because the web half has been previously doubled up. The two folds of the web half have been very easy to slip longitudinally one over the other, resulting in wrinkling, as well as transversely, resulting in both wrinkling and deviating of the web half away from the predetermined path. In either case the production of the press has suffered immensely in quality.

Another known approach to multiple-center-spread signatures is found in the article entitled, "Development of Double Center Spread Systems, " in the 1997-1 issue, No. 159 Pages 78–81, of Newspaper Technology published by Japan Newspaper Association on Mar. 25, 1997. The article suggests the provision of two formers in vertically spaced positions for folding two webs in the folding section of a rotary printing press. Between the two formers are, here again, an angled guide bar, a set of rollers for guiding the web from the upper former to the bar, and another set of rollers for guiding the web from the bar to the lower former.

The upper former longitudinally folds a web that is to provide an additional center spread. The angled guide bar turns the folded web 90 degrees in phase, into a face-to-face relationship with the other webs which have been printed by other printing units but which are not yet folded. The additional center-spread web, folded and turned 90 degrees, is inserted between the unfolded other webs, with the fold of the folded web in register with the centerlines of the unfolded webs. The superposed webs subsequently travel past the lower former, by which only the unfolded webs are folded. The webs, now all folded, are then cut and folded transversely into signatures of a predetermined number of pages, in which there are at least two center spreads.

This second prior art system is also said to permit adaptations for greater numbers of center spreads in each signature, by providing an additional former or formers and additional angled guide bar or bars, together with an additional web or webs to provide an additional center spread or spreads. After being printed, folded, and turned 90 degrees in phase, such additional web or webs are to be inserted between on the other printed webs before the latter are folded at its own former.

Just like the first recited prior art device, this second one has the angled guide bar together with the associated rollers for turning the first web 90 degrees as it travels between the two formers which are oriented in the same direction. Traveling in frictional engagement with the angled bar, the web has been just as likely to give rise to the noted inconveniences as in the first prior art device. An additional drawback is that, disposed in the narrowly confined space between the two formers, the guide bar and rollers have been very difficult of maintenance.

Both guide bar and guide rollers can be dispensed with, and the difficulties arising therefrom overcome, if the two formers are oriented with an angular difference of 90 degrees therebetween, as indeed disclosed in Japanese Unexamined Utility Model Publication No. 58-87748. However, this conventional device merely teaches to fold a web twice longitudinally by guiding it through the successive formers. It discloses no means whatsoever for guiding one folded web into superposition with other, unfolded webs before feeding these webs to the other former. This known device should not therefore be taken as anticipatory of the instant invention, it being totally unapplicable to the creation of multiple-center-spread signatures.

SUMMARY OF THE INVENTION

The present invention has it as an object to create one or more additional center spreads in each multiple-page signature produced by a rotary printing press and, in so doing, to defeat all the inconveniences and difficulties encountered heretofore.

A more specific object of the invention is, in feeding from one former to another the web to form an additional center spread in each signature, to make its travel smoother and more friction-free than heretofore thereby avoiding the wrinkling of the web or its deviations from the normal path.

Another object of the invention is to make possible the insertion of an additional center spread between any two desired pages of each signature.

A further object of the invention is to make possible the insertion of one or more additional center spread between any two desired pages on either side of the centerline folds of each signature.

A further object of the invention is to make possible the insertion of one or more additional center spreads between any two desired pages on each of opposite sides of the centerline fold of the signature.

A still further object of the invention is to make the rotary printing press readily adaptable for creation of practically any desired number of center spreads in each signature.

The present invention may be summarized as a web-fed rotary printing press comprising a plurality of printing units for printing on as many webs of paper or like printable material traveling in centerline alignment and in phase with one another. A preselected one of the printed webs is first turned 90 degrees out of phase with the other, unselected webs by angle guide means and then along its centerline by a first former, herein termed preselected web former, back into phase with the unselected webs. The preselected and unselected webs are then all superposed one upon another, with the fold of the preselected web in register with the aligned centerline of the unselected webs. Disposed downstream of the superposing means is a second former, herein termed unselected web former, which is offset 90 degrees out of phase with the preselected web former for folding the superposed webs along the aligned centerline of the unselected webs. Then the folded webs are conventionally cut into predetermined lengths, and preferably folded across the middle as in the case of newspaper production, to provide multiple-page signatures each having at least one center spread, formed by the preselected web, in addition to the usual inmost center spread formed by one of the unselected webs.

It should be noted that the present invention suggests a reversal of the conventional practice of prefolding a preselected web at 90 degrees out of phase with the unselected webs and then guiding the prefolded web back into phase with the unselected webs. The preselected web is first guided at 90 degrees out of phase with the unselected webs according to the invention and then folded by the preselected web former, which is 90 degrees out of phase with the unselected web former, back into phase with the unselected webs. Both preselected and unselected webs all travel in phase with one another from preselected web former to unselected web former via the superposing means.

Thus, being not required to undergo any change in phase after being folded by the preselected web former, the preselected web is not to suffer wrinkling or relative displacement of its folds as it travels with the other webs to the unselected web former. The preselected web will therefore be turned into flawlessly printed, folded, and positioned center spreads.

Preferably, lead-in guide means are provided for permitting any of the webs that have been printed by the printing units to be fed to the angle guide means as a preselected web and for guiding the unselected webs around the angle guide means and the preselected web former and directly to the superposing means. An additional center spread can be placed between any desired pages on one side of the centerline folds of each signature.

In another preferred embodiment of the invention the preselected web former is made angularly displaceable between positions of bilateral symmetry with respect to a plane containing the tip of that former and the aligned centerline of the unselected webs. Folded by this former, the preselected web can then be placed on either side of the aligned centerline of the unselected webs by the superposing means, providing an additional center spread on either side of the centerline folds of each signature.

Two preselected web formers are provided in combination with two angle guide means in each of two other preferred embodiments of the invention. The two preselected web formers are of the same orientation in one embodiment, and of opposite orientations in the other. Combined with lead-in guide means, the two preselected web formers of the same orientation make it possible to create two center spreads between any desired pages, either consecutively or separately, on one side of the centerline folds of each signature. Also combined with lead-in guide means, the two preselected web formers of opposite orientations make it possible to provide two center spreads between any desired pages on opposite sides of the centerline folds of each signature.

In a further preferred embodiment of the invention there are provided three preselected web formers in combination with as many angle guide means. One preselected web former and one angle guide means are oriented in a direction opposite to the orientation of the other two preselected web formers and the other two angle guide means. Combined with lead-in guide means, they make it possible to create two center spreads between any desired pages, either consecutively or individually, on one side of the centerline folds of each signature, and one other center spread between any desired pages on the other side of the centerline folds of each signature.

The above and other objects, features and advantages of this invention and the manner of achieving them will become more apparent, and the invention itself will best be understood, from a study of the following description and attached claims, with reference had to the accompanying drawings showing the preferred embodiments of the invention.

DESCRIPTION OF THE PREFERRED EMBODIMENTS

The present invention will now be described as embodied by way of example in the web-fed rotary printing press having five printing units in a row for production of 20-page signatures each including two center spreads, one in the usual inmost position and an additional one between two other pages. Also, in this particular embodiment, the additional center spread is made insertable between any two selected ones of the five sheets making up each signature.

Figure 1:
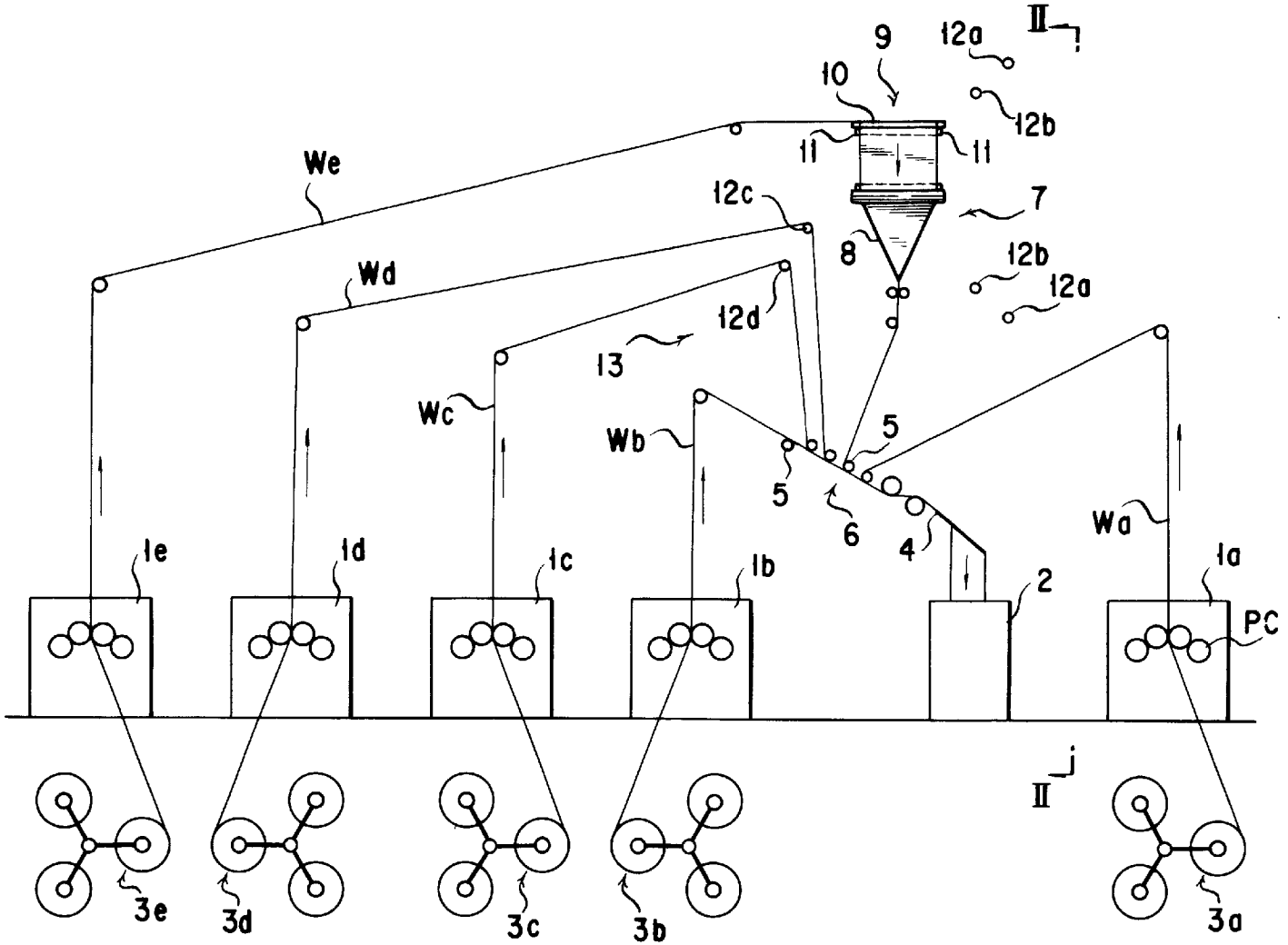
FIG. 1 is a diagrammatic illustration of a first preferred form of web-fed rotary printing press according to the present invention, which is designed specifically for production of twenty-page, double-center-spread signatures.

Diagrammatically illustrated in FIG. 1 is the rotary printing press having five printing units 1*a*, 1*b*, 1*c*, 1*d* and 1*e* each having a pair of plate cylinders PC for printing on both sides of webs Wa Wb, Wc, Wd and We as these webs are supplied from their respective paper feeders 3*a*, 3*b*, 3*c*, 3*d* and 3*e*. All the printing units 1*a*–1*e* are aligned, and all their plate cylinders PC arranged parallel to one another. Consequently, printed by these printing units and at least just issuing therefrom, all the webs Wa–We travel in centerline alignment and in phase with one another, although one of these webs must temporarily go out of alignment and out of phase with the others in order to provide an additional center spread according to this invention. It is understood that all the webs Wa–We handled in this machine have each of the width equal to the longitudinal dimension of the signatures, when they are fully unfolded, to be produced.

Figure 2:
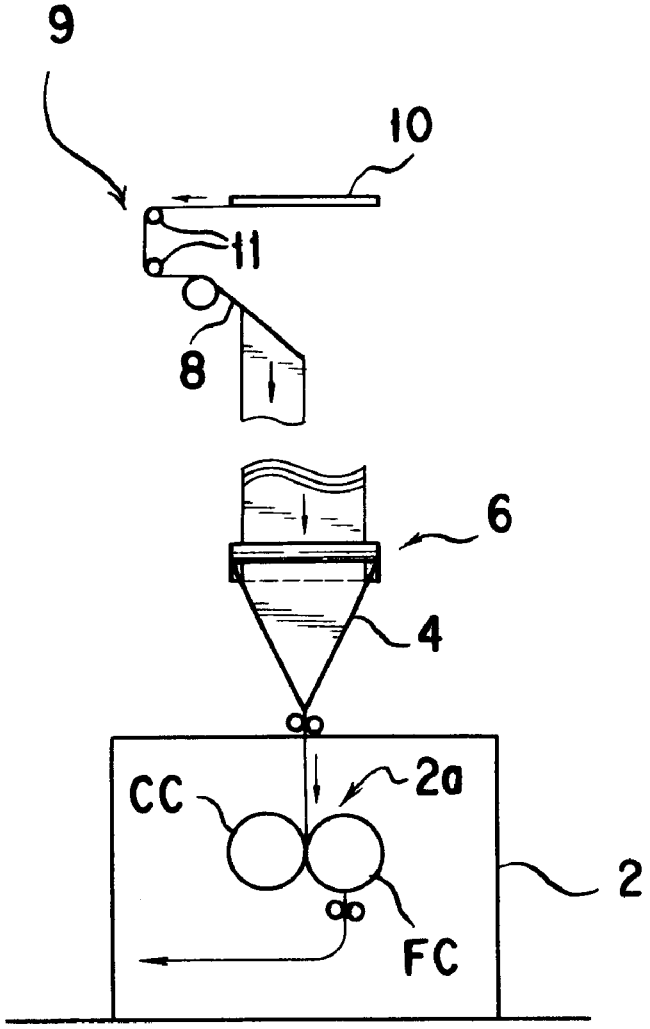
FIG. 2 is a section taken along the line II—II in FIG. 1 and looking in the direction of the arrows.
Figure 3:
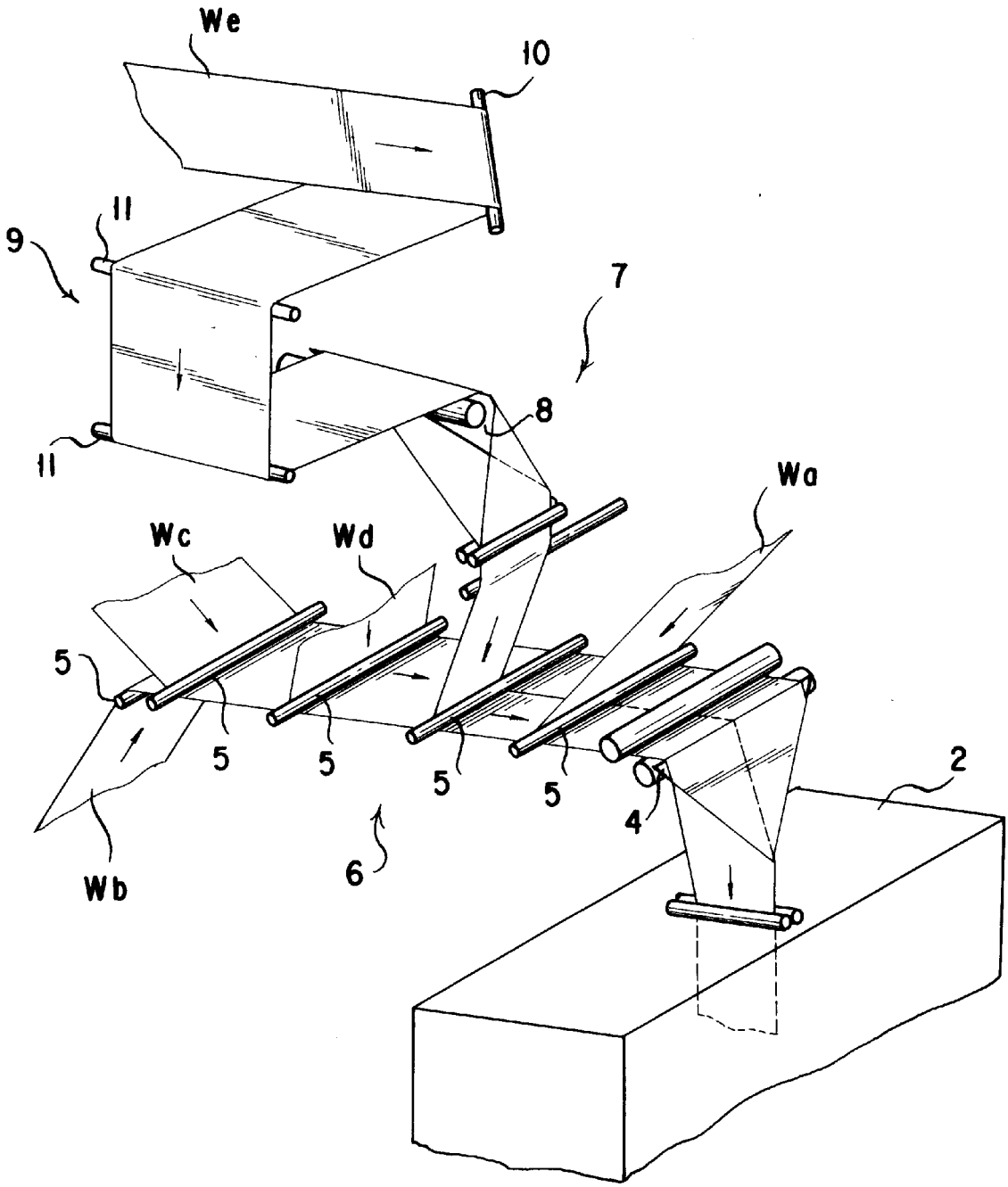
FIG. 3 is an enlarged, fragmentary perspective view showing in particular how a preselected web is turned 90 degrees in phase, folded, and superposed with the other webs in the printing press of FIGS. 1 and 2.

At 2 in FIG. 1, as well as in FIGS. 2 and 3, is shown a cutting and folding device of conventional design including a coacting pair of folding cylinder FC and cutting cylinder CC. These cylinders operate in a well known manner to cut all the printed webs into individual sheets and fold them across the middle into signatures each with two center spreads.

Since the cutting and folding device 2 is shown interposed between the printing units 1*a* and 1*b* in the illustrated embodiment, the webs Wa and Wb printed by these printing units are to form the outmost and inmost sheets, respectively, of the signatures, with the web Wb providing the usual inmost center spread in each signature. An additional center spread is to be formed by the web We from the extreme left-hand printing unit 1*e*, and inserted between the webs Wa and Wd, according to the showing of FIG. 1, although other two webs Wc and Wd can also be each turned into a center spread instead of the web We, as will become apparent as the description proceeds.

As shown also in FIGS. 1–3, just upstream of the cutting and folding device 2 with respect to the arrow-marked traveling direction of the webs Wa–We, there is conventionally provided a former 4 in the shape of a triangular plate for folding the webs Wa, Wb, Wc and Wd along their centerlines. The former 4 is so shaped, positioned, and oriented as to fold the webs into a plane at right angles with the planes of the webs before being folded and to guide the folded webs into the underlying cutting and folding device 2.

Further upstream of the former 4 there are provided means 6 for superposing all the webs Wa–We one upon another. The superposing means 6 are shown comprising as many guide rolls 5, all laid parallel and practically in coplanar relationship to each other, as there are webs to be superposed.

Disposed over the superposing means 6 are means 7 required according to the invention for longitudinally prefolding a preselected web, shown as We in FIGS. 1–3, preparatory to superposing it with the other, unselected webs Wa–Wd and turning it into an additional center spread in each signature. Such means 7 includes a former 8 for folding the preselected web We, and angle guide means 9 for guiding the preselected web to that former. This former 8 will be hereinafter referred to as the preselected web former, and the first recited former 4 as the unselected web former, for contradistinction from each other.

The preselected web former 8 is oriented 90 degrees out of phase with the unselected web former 4. Furthermore, as will be best understood from FIG. 2, the extreme tip of the preselected web former 8 lies in a vertical plane containing the centerlines of the unselected webs Wa–Wd and the tip of the unselected web former 4, in order that the preselected web We may have its fold, created by the preselected web former, in register with the centerline of the unselected webs on being superposed therewith by the means 6.

Lying upstream of the preselected web former 8 according to a feature of this invention, the angle guide means 9 turns the preselected web We 90 degrees out of phase with the unselected webs Wa–Wd before being folded by the preselected web former 8. To this end the angle guide means 9 includes a guide rod 10 angled 45 degrees to the traveling direction of the preselected web We for giving a 90-degree turn to this web as the same is folded thereover, and a series of guide rollers 11 for guiding the web to the preselected web former 8 with its phase unchanged.

According to an ancillary feature of the invention there are provided laid-in guide means 13, FIG. 1, comprising guide rollers 12*a*, 12*b*, 12*c* and 12*d* for guiding all but the preselected one of the three intermediate webs Wc, Wd and We from their printing units 1*c*, 1*d* and 1*e* directly to the superposing means 6, bypassing the prefolding means 7. Since the web We is preselected as an additional center spread web and directed to the angle guide means 9 in this particular embodiment, the other two intermediate webs Wc and Wd are shown bypassing the prefolding means 7, being guided by the rollers 12*c* and 12*d* directly to the superposing means 6. The three intermediate webs Wc–We may be rethreaded, however, for using either web Wc or Wd, instead of web We, as an additional center spread web, as will be later discussed in more detail with reference to FIG. 4.

Operation

First, unwound from their stocks 3*a*–3*e* and directed through the printing units 1*a*–1*e*, all the webs Wa–We may be threaded through the rest of the apparatus as depicted by way of example in FIG. 1. The webs Wa and Wb may be threaded around the extreme righthand and extreme left-hand ones, respectively, of the five superposing rolls 5 to form the outmost and inmost sheets of each signature to be produced. The webs Wc and Wd, to form inside sheets of each signature, may be threaded around the lead-in guide rollers 12*c* and 12*d* and, bypassing the prefolding means 7 which forms additional center spreads, are then threaded around two neighboring superposing rolls 5 next to the extreme left-hand one. To provide an additional center spread in each signature, the web We may be folded over the angled guide rod 10 as in FIG. 3 and directed to the preselected web former 8 via the guide rollers 11 and thence to the remaining one superposing roll 5 next to the extreme righthand one.

As the machine is set into operation, all the webs Wa–We will have their opposite sides printed by the respective printing units 1*a*–1*e*. The four unselected webs Wa–Wd, excluding the preselected web We, will be superposed on one another in centerline alignment on traveling through the superposing rolls 5. Then, jointly folded down their centerline by the unselected web former 4, the unselected webs Wa–Wd will enter the cutting and folding device 2.

The preselected web We, on the other hand, will be turned 90 degrees out of phase with the unselected webs Wa–Wd on traveling over the angled guide rod 10 and subsequently folded down the middle by the preselected web former 8, before being directed to the superposing means 6.

Since the preselected web former 8 is 90 degrees out of phase with the unselected web former 4, the preselected web We will be turned another 90 degrees on being thereby folded, back into phase with the unselected webs Wa–Wd. The preselected web We may therefore be fed directly from the former 4 to superposing means 6, with its phase left unchanged, and superposed with the unselected webs Wa–Wd. Moreover, such being the position of the tip of the preselected web former 8, the fold of the preselected web We that has been created by this former will come into register with the centerline of the other webs Wa–Wd on being superposed therewith as above.

Then all the superposed webs Wa–We will be fed into the unselected web former 4, by which only the unselected webs Wa–Wd will be folded down the centerline, with the preselected web We left unfolded, it having been placed on one side of the centerline of the unselected webs.

Then all the folded webs Wa–We will enter the cutting and folding device 2. Passing between folding cylinder FC and cutting cylinder CC, the webs will be conventionally cut into predetermined lengths and folded across the middle into double-center-spread signatures.

As has been stated, the three Wc, Wd and We of the five webs Wa–We shown in FIG. 1 may be rethreaded for use of any one of the three as an additional center spread web. Indicated by the solid lines in FIG. 4 are how the five webs are threaded in the above described case where the web We is preselected and guided to the prefolding means 7, with the webs Wc and Wd bypassing the same by being guided by the lead-in guide rollers 12*c* and 12*d*.

Figure 5A:
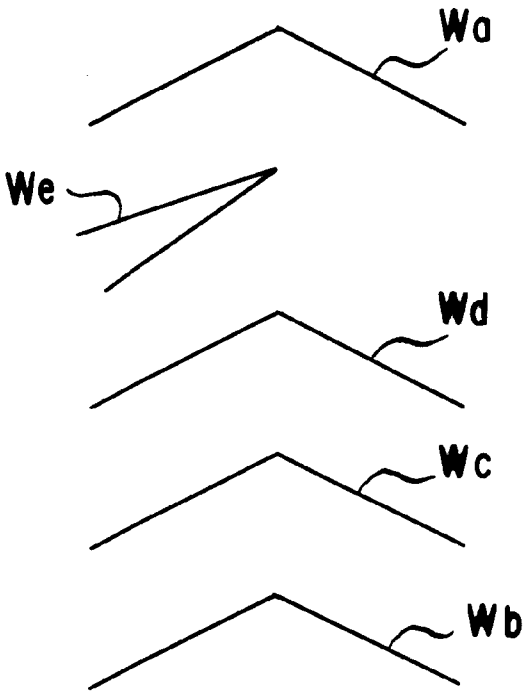
FIGS. 5A, 5B and 5C are diagrammatic illustrations of three different double-center-spread signature configurations producible by the FIG. 1 printing press as the webs are threaded therethrough as indicated in FIG. 4.

The resulting signature configuration is depicted in FIG. 5A. The web We is turned into a center spread, in addition to the regular inmost center spread formed by the web Wb, and interposed between the two outer sheets Wa and Wd.

Figure 4:
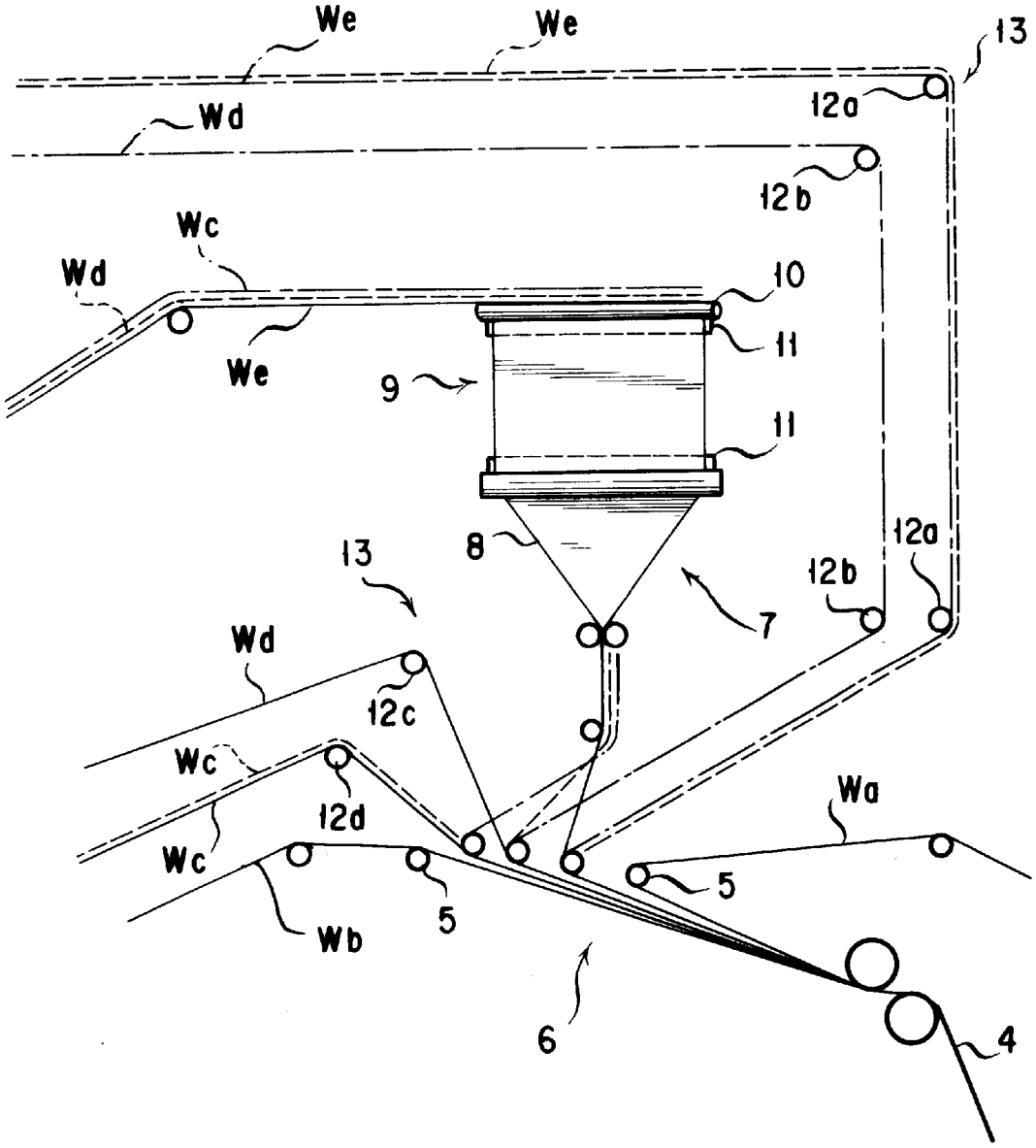
FIG. 4 is an enlarged, fragmentary elevational view of the FIG. 1 printing press, the view being explanatory of how the webs are threaded through the machine to create an additional center spread between desired pages of each signature.

The three webs Wc, Wd and We may be rethreaded as indicated by the dashed lines in FIG. 4 for turning the web Wd into an additional center spread. This web Wd must of course be directed to the prefolding means 7. The web Wc may be guided around the prefolding means 7 by the same lead-in guide roller 12*d* as in the first described case, and the web We may be likewise guided around the prefolding means by the lead-in guide roller 12*a*.

Figure 5B:
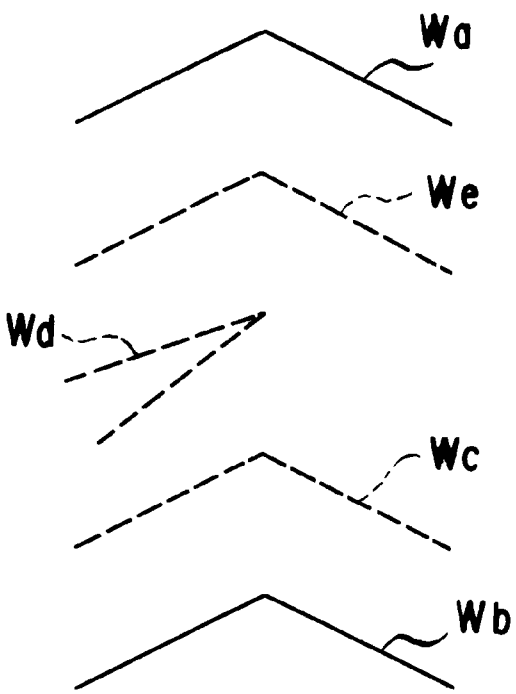

The resulting double-center-spread signature configuration is as pictured in FIG. 5B, having the additional center spread Wd between the sheets Wc and We.

The alternating dot-and-dash lines in FIG. 4 demonstrate how the three webs Wc Wd and We are threaded when the web Wc is preselected and fed into the prefolding means 7 for use as an additional center spread web. The other webs Wd and We may then be guided by the lead-in guide rollers 12*a* and 12*b* around the prefolding means 7, directly to the superposing means 6.

Figure 5C:
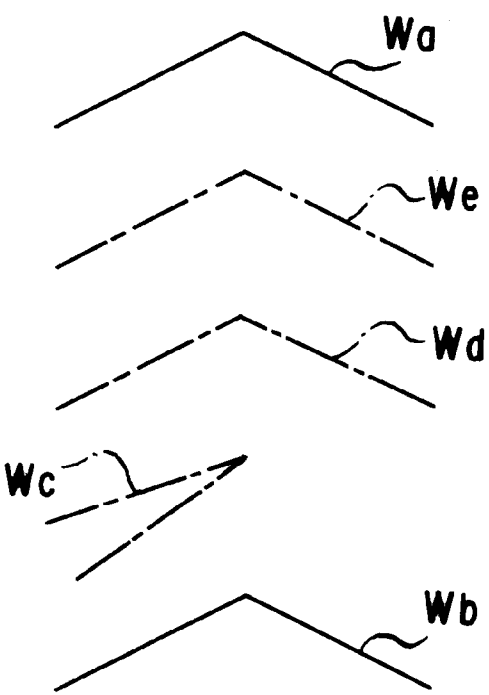

FIG. 5C shows the resulting double-center-spread signature, with the additional center spread Wc sandwiched between the two inmost sheets Wb and Wd.

Second Form (FIGS. 6–9)

A reconsideration of FIGS. 5A–5C will reveal that the additional center spread is inserted only on the same side of the web centerline folds of the other sheets in each of the three different double-center spread signatures produced by the FIG. 1 machine. This machine is readily adaptable for insertion of an additional center spread on either side of the centerline folds of signatures, and in either of the noted three different positions on each side.

Figure 6:
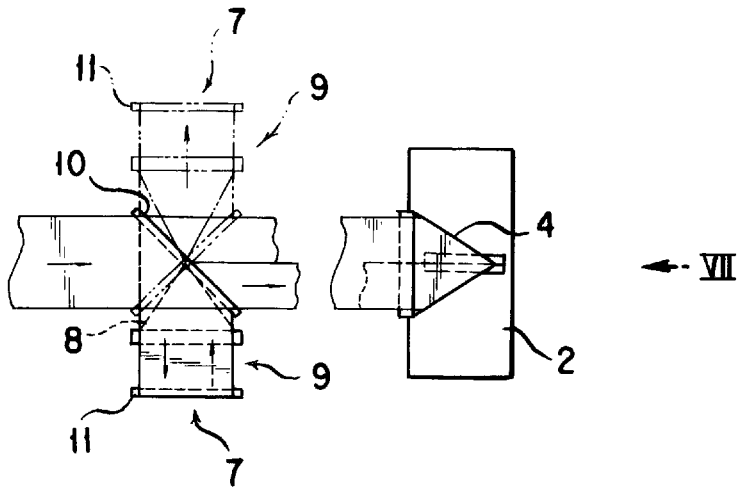
FIG. 6 is a diagrammatic, fragmentary top plan of a second preferred form of rotary printing press according to the invention, which is designed for production of double-center-spread signatures, with an additional center spread on either side of the centerline folds of each signature.
Figure 7:
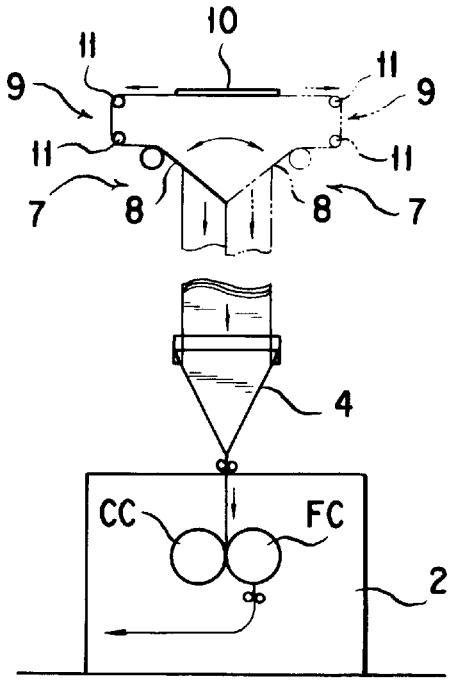
FIG. 7 is a diagrammatic, fragmentary view of the FIG. 6 printing press as seen in the direction of the arrow VII therein.

FIGS. 6–9 are directed to a second embodiment of the invention which differs from the preceding one in that the preselected web former 8 and the associated guide rollers 11 are both supported for angular displacement about a vertical axis passing the tip of the preselected web former, between the two positions indicated by the solid and the broken lines in FIGS. 6 and 7. The first position, indicated by the solid lines, is the same as their position in FIGS. 1–5, offset 90 degrees in one direction out of phase with the unselected webs. The broken-line second position is offset 90 degrees in the opposite direction, that is, displaced 180 degrees from the first position. The two positions are therefore symmetrical with respect to a vertical plane containing the aligned centerline of the unselected webs.

Further, in compliance with the 180-degree displacement of the preselected web former 8 and guide rollers 11, the angled guide rod 10 is made pivotable 90 degrees in a horizontal plane about its midpoint, as indicated also by the solid and broken lines in FIG. 6. The solid-line first position of the guide rod 10 is the same as in FIG. 3, set at 45 degrees to the traveling direction of the preselected web before being folded over the rod. The broken-line second position is displaced 90 degrees from the first position. The other details of construction are as set forth above in connection with the FIGS. 1–5 embodiment.

Alternatively, even though the preselected web former 8 may be left angularly displaceable as above, there may be provided two sets of angled guide rods 10 and guide rollers 11 in the noted two positions. Either set may be put to use depending upon whether the former 8 is in the solid-line or the broken-line position.

Operation of Second Form

The machine will produce the same double-center-spread signatures as shown in FIGS. 5A–5C, with the additional center spread inserted in the left-hand side, as seen in these figures, of the centerline folds of the other sheets in each signature, when the preselected web former 8, guide rollers 11, and angled guide rod 10 are in the solid-line positions of FIGS. 6 and 7. The webs may be rethreaded as has been set forth with reference to FIG. 4 for changing the position of the additional center spread between the pages of each signature on the same side of the centerline folds.

Figure 8:
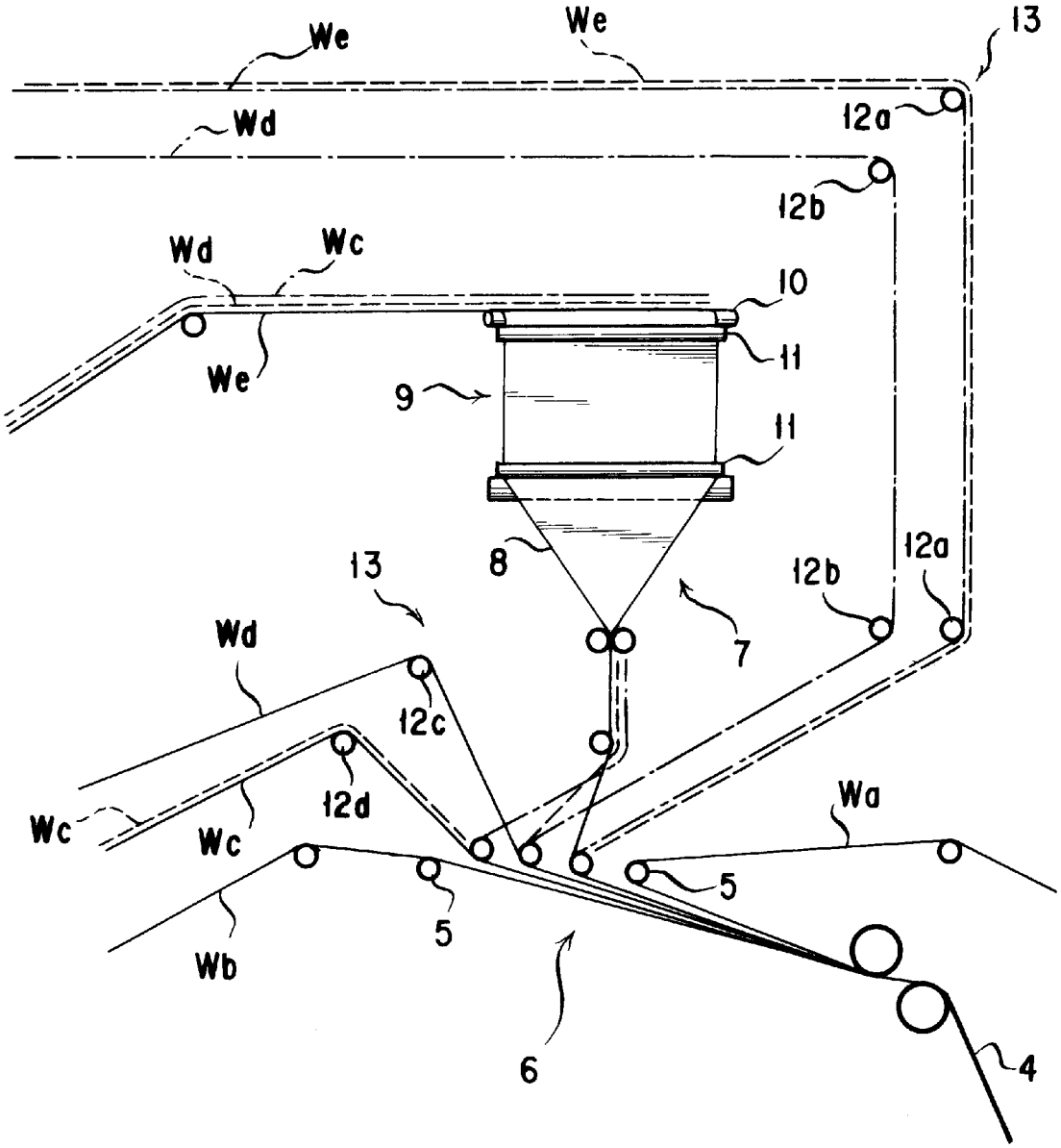
FIG. 8 is a view similar to FIG. 4 but explanatory of how the webs are threaded through the FIG. 6 machine to create an additional center spread between desired pages of each signature.
Figure 9A:
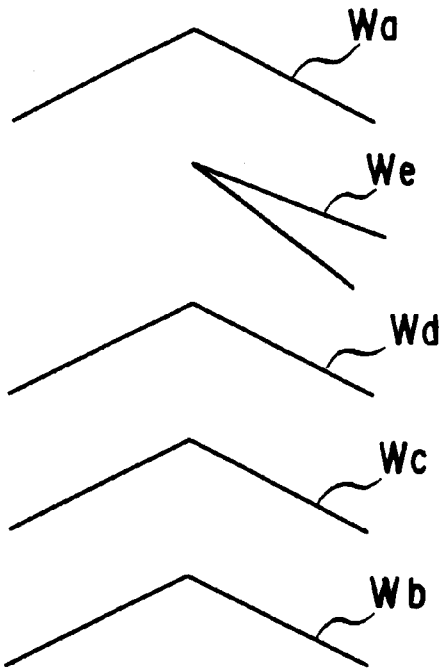
FIGS. 9A, 9B and 9C are diagrammatic illustrations of three different double-center-spread signature configurations producible by the FIG. 6 printing press as the webs are threaded therethrough as indicated in FIG. 8.
Figure 9B:
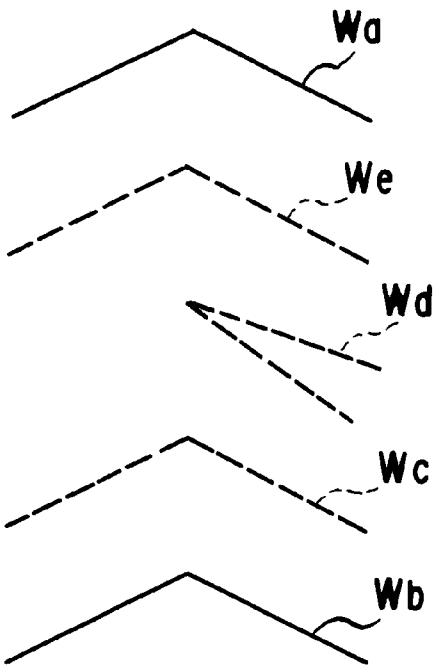
Figure 9C:
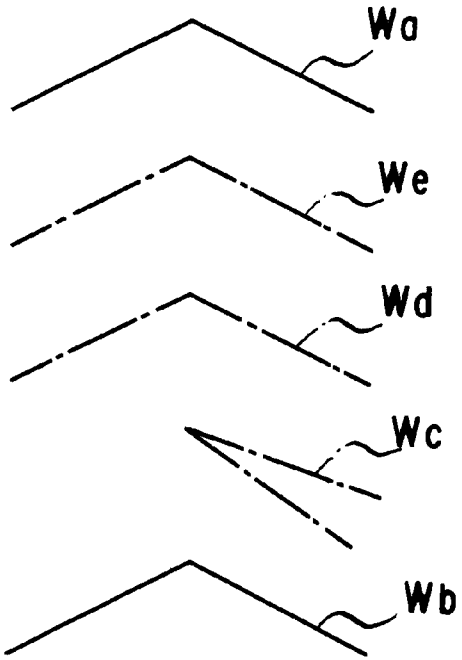

It will now be apparent that an additional center spread is inserted in the other side of the centerline folds in each signature when the preselected web former 8, guide rollers 11, and angled guide rod 10 are all moved from the solid-line to the broken-line positions of FIGS. 6 and 7. FIG. 8 is explanatory of how the five webs Wa–We are threaded, and rethreaded, through the apparatus when the preselected web former 8, guide rollers 11, and angled guide rod 10 are in the broken-line positions of FIGS. 6 and 7. Although the web paths depicted here are essentially identical with those of the preceding embodiment shown in FIG. 4 except for the orientations of the specified members 8, 10 and 11, the additional center spreads are inserted in the righthand side of the centerline folds in each signature in each of the three cases shown in FIGS. 9A, 9B and 9C.

Third Form (FIGS. 10–13)

Figure 10:
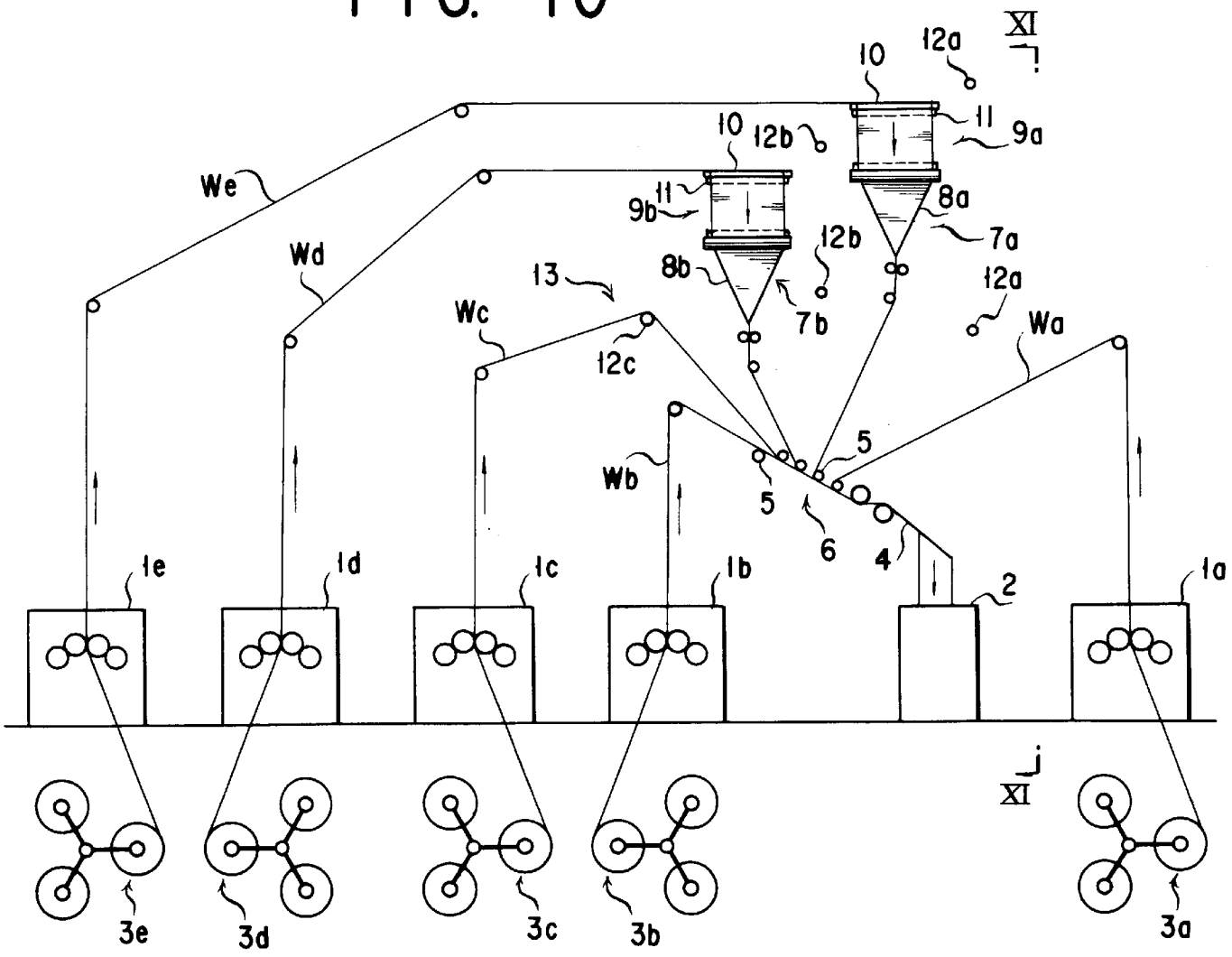
FIG. 10 is a view similar to FIG. 1 but showing a third preferred form of rotary printing press according to the invention, which is designed for production of triple-center-spread signatures, with two additional center spreads on one side only of the centerline folds of each signature.
Figure 11:
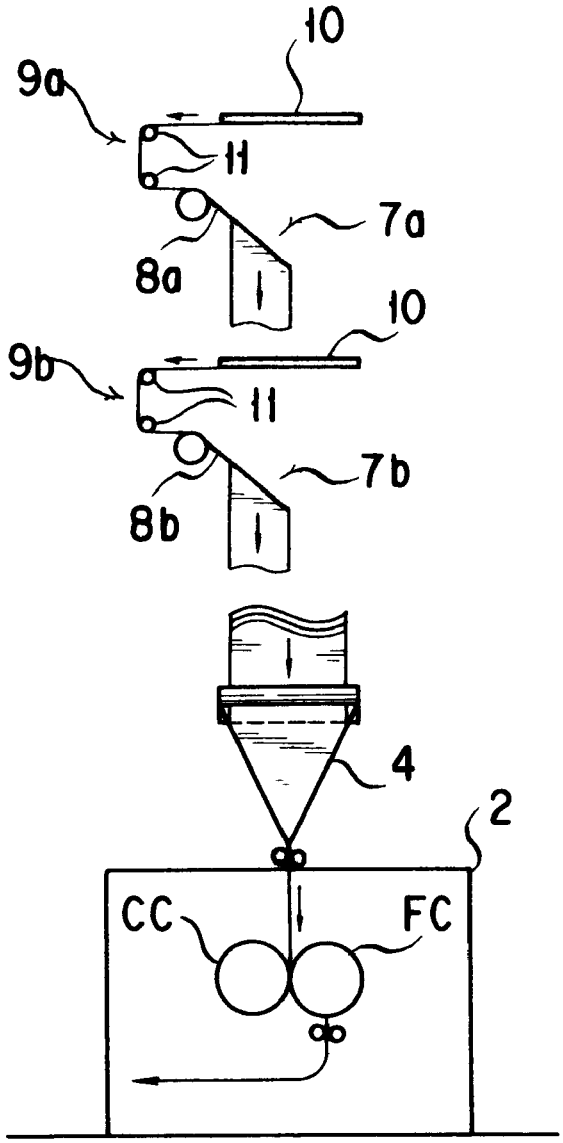
FIG. 11 is a section taken along the line XI—XI in FIG. 10 and looking in the direction of the arrows.

In FIGS. 10 and 11 is shown the printing press adapted for production of triple-center-spread signatures, that is, those having two additional center spreads in each signature, instead of one as in the foregoing embodiments, on one side only of the centerline folds of the other sheets in each signature. The triple-center-spread machine incorporates two prefolding means 7*a* and 7*b* disposed at both horizontal and vertical spacings from each other for ease of web threading. The prefolding means 7*a* and 7*b* have preselected web formers 8*a* and 8*b* and angle guide means 9*a* and 9*b*, respectively, all oriented in the same directions as their counterparts in the FIGS. 1–5 embodiment. Although spaced as aforesaid both horizontally and vertically from each other, the formers 8*a* and 8*b* have their tips lying in the same vertical plane containing the aligned centerline of the unselected webs, which are shown to be Wa, Wb and Wc in FIG. 10.

For guiding the unselected webs around the two prefolding means 7*a* and 7*b*, there are provided lead-in guide rollers 12*a*, 12*b* and 12*c* of slightly modified placement. The other details of construction are as previously described with reference to FIGS. 1–5.

Operation of Third Form

Any two of the three inside webs Wc, Wd and We may be preselected to provide two additional center spreads in each triple-center-spread signature desired. Both FIGS. 10 and 12 indicate by the solid lines how all the webs Wa–We are threaded through the machine in the case where Wd and We are preselected. The preselected web Wd is shown directed to the prefolding means 7*b*, and the other preselected web We to the other prefolding means 7*a*. The unselected inside web Wc is shown guided directly to the superposing means 6 by the lead-in guide roller 12*c*.

Figure 13A:
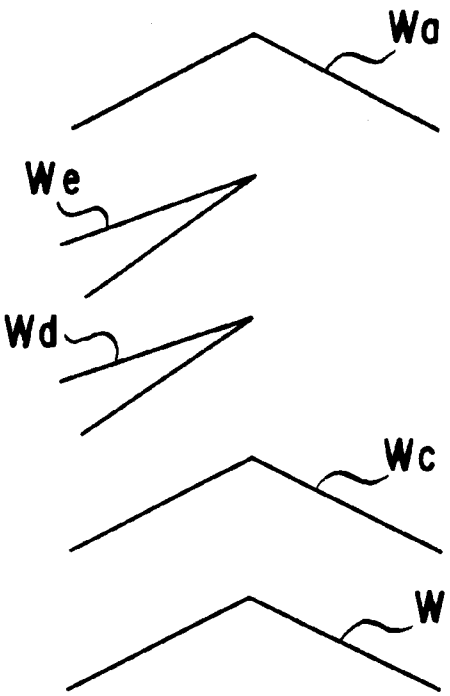
FIGS. 13A, 13B and 13C are diagrammatic illustrations of three different triple-center-spread signature configurations producible by the FIG. 10 printing press as the webs are threaded therethrough as indicated in FIG. 12.

FIG. 13A shows the resulting triple-center-spread signature configuration. The preselected webs Wd and We are turned into two consecutive center spreads that are inserted between the sheets Wa and Wb and on the same side of their centerline folds.

Figure 12:
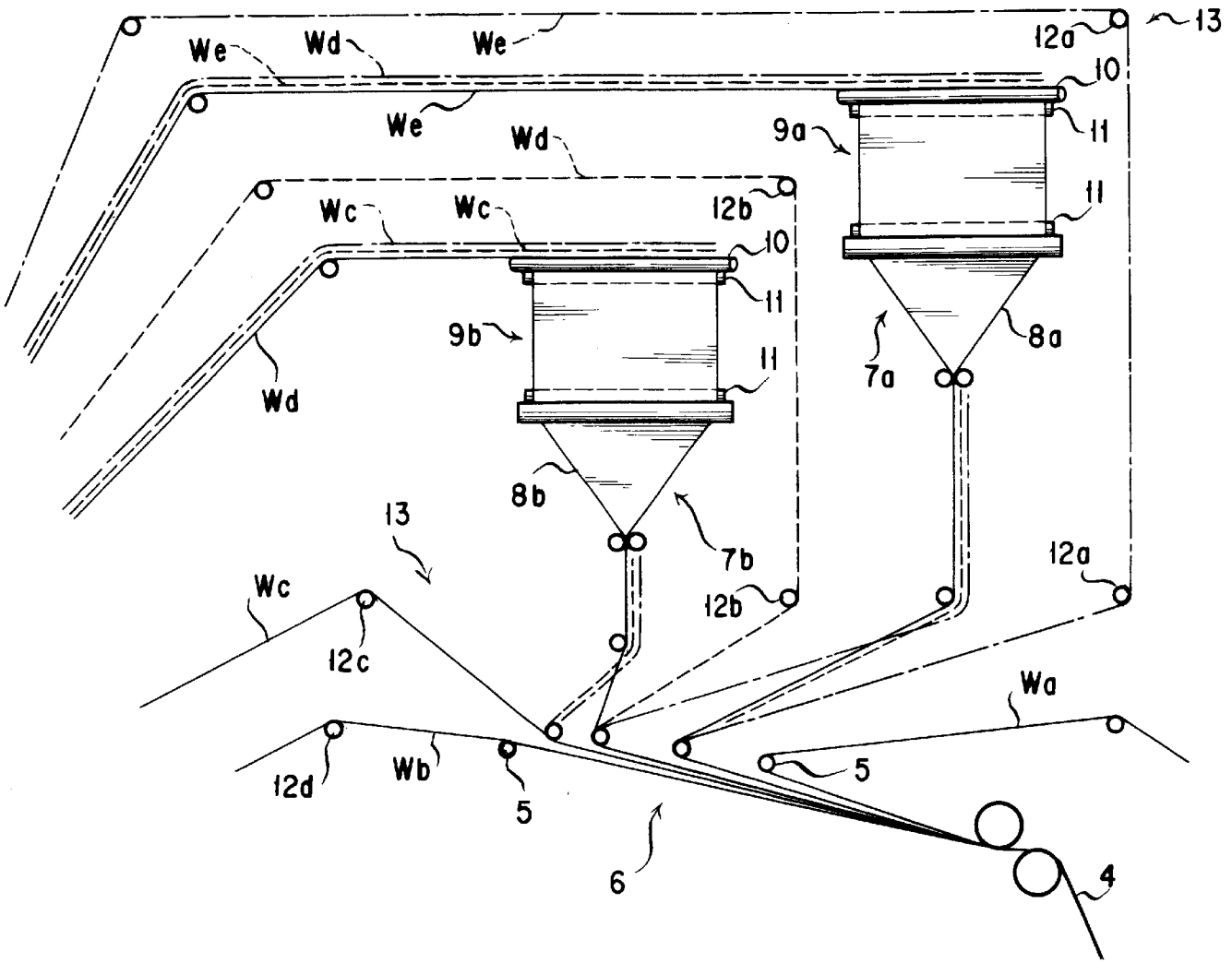
FIG. 12 is a view similar to FIG. 4 but explanatory of how the webs are threaded through the FIG. 10 machine to create two additional center spreads between desired pages of each signature.

The three inside webs Wc, Wd and We may be rethreaded as indicated by the dashed lines in FIG. 12 for turning the webs Wc and We into additional center spreads. The preselected web Wc is shown directed to the prefolding means 7*b*, and the other preselected web We to the other prefolding means 7*a*. The unselected inside web Wd is shown guided directly to the superposing means 6 by the lead-in guide rollers 12*b* interposed between both prefolding means 7*a* and 7*b*.

Figure 13B:
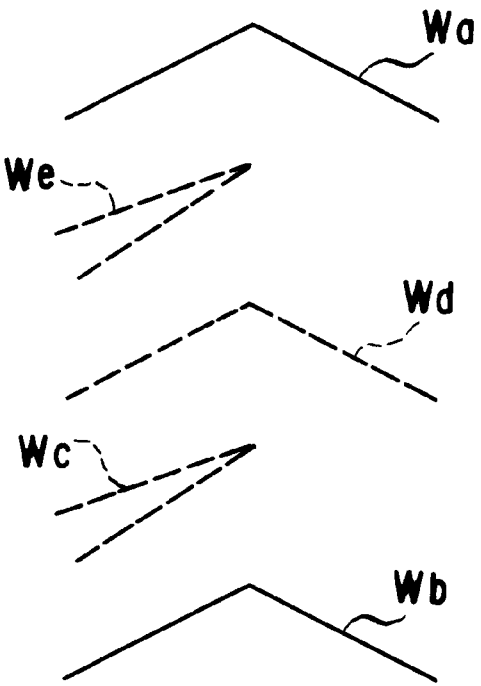

The resulting triple-center-spread signature configuration is as pictured in FIG. 13B. The preselected web Wc forms one additional center spread between the sheets Wb and Wd, and the other preselected web We another additional center spread between the sheets Wa and Wd. Both additional center spreads Wc and We are on the same side of the centerline folds of the sheets Wa, Wb and Wd.

The alternating-dot-and-dash lines in FIG. 12 demonstrate how the three webs Wc Wd and We are threaded when the webs Wc and Wd are preselected and directed the prefolding means 7*a* and 7*b*. The remaining unselected inside web We is shown guided by the lead-in guide rollers 12*a* around both prefolding means 7*a* and 7*b*.

Figure 13C:
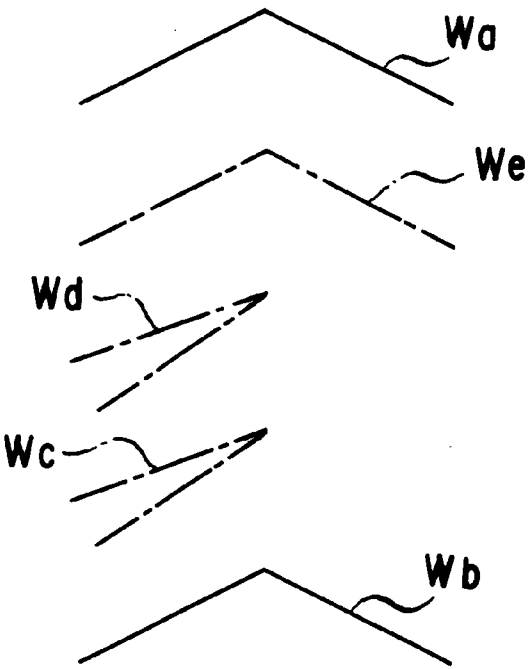

FIG. 13C shows the resulting triple-center-spread signature. The two additional center spreads Wc and Wd are sandwiched between the sheets Wb and We and on the same side of the centerline folds of these sheets.

Figure 14:
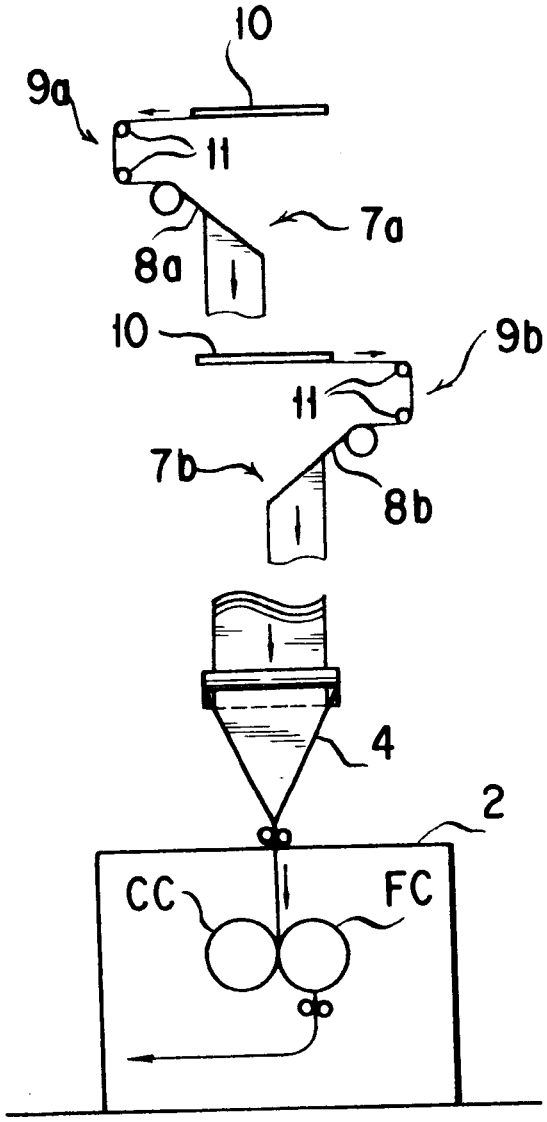
FIG. 14 is a view similar to FIG. 2 but showing a fourth preferred form of rotary printing press according to the invention, which is designed for production of triple-center-spread signatures, with two additional center spreads on both sides of the centerline folds of each signature.
Figure 15:
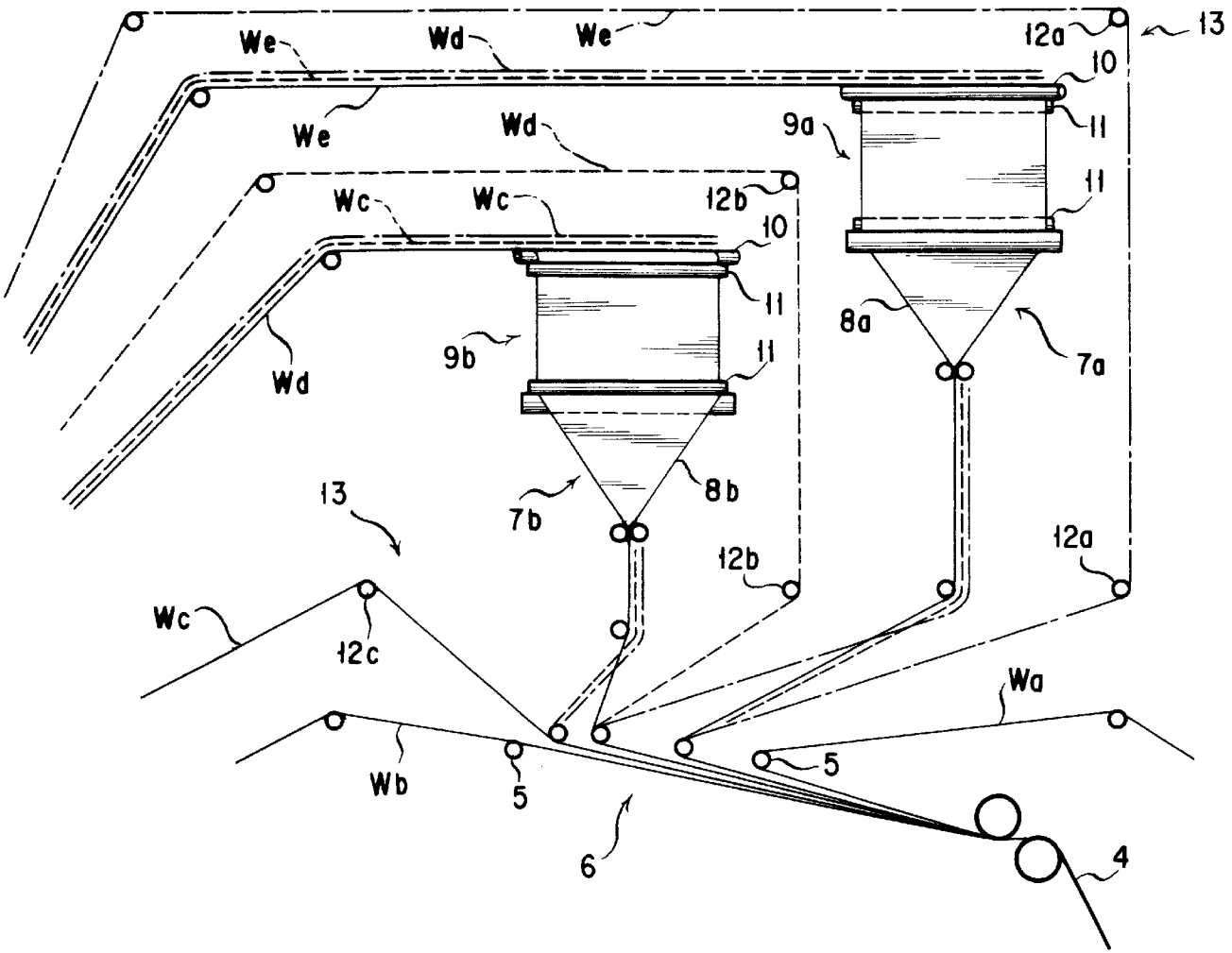
FIG. 15 is a view similar to FIG. 4 but explanatory of how the webs are threaded through the FIG. 14 machine to create two additional center spreads between desired pages on both sides of the centerline folds of each signature.

Fourth Form (FIGS. 14–16)

It may be desired in some instances to create two additional center spreads on both sides of the centerline fold in each signature, instead of on one side only as in the triple-center-spread machine of FIGS. 10–13. Built for accomplishment of this objective, the printing press shown FIGS. 14 and 15 differs from the FIGS. 10–13 machine in that the preselected web formers 8*a* and 8*b* of two prefolding means 7*a* and 7*b* are disposed opposite each other, or 180 degrees out of phase with each other. The tips of both formers 8*a* and 8*b* lie, despite their opposite orientations, in the same vertical plane containing the aligned centerline of the unselected webs.

The angle guide means 9*a* and 9*b* are of course oriented to conform to the orientations of the preselected web formers 8*a* and 8*b*, respectively. More specifically, as will be understood from FIG. 14, the angled guide rods 10 and guide rollers 11 of the angle guide means 9*a* and 9*b* are oriented to turn two preselected webs 90 degrees in opposite directions out of phase with the unselected webs. FIG. 15 indicates that these unselected webs are guided around the two prefolding means 7*a* and 7*b* by the lead-in guide rollers 12*a*, 12*b* and 12*c* of the same placement as in FIG. 12. The other details of construction are as previously described with reference to FIGS. 1–5.

Operation of Fourth Form

As in the FIGS. 10–13 embodiment, any two of the three inside webs Wc, Wd and We may be preselected to provide two additional center spreads in each triple-center-spread signature desired. FIG. 15 indicates by the solid lines how all the webs Wa–We are threaded through the machine in the case where Wd and We are preselected. The preselected web Wd is shown directed to the prefolding means 7*b*, and the other preselected web We to the other prefolding means 7*a*. The unselected inside web Wc is shown guided directly to the superposing means 6 by the lead-in guide roller 12*c*.

Figure 16A:
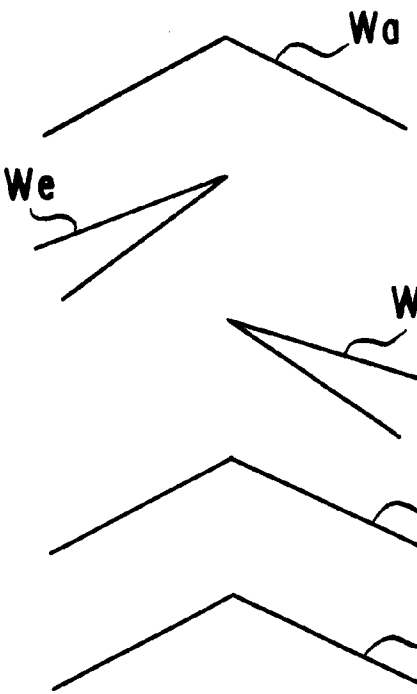
FIGS. 16A, 16B and 16C are diagrammatic illustrations of three different triple-center-spread signature configurations producible by the FIG. 14 printing press as the webs are threaded therethrough as indicated in FIG. 15.

FIG. 16A shows the resulting triple-center-spread signature configuration. The preselected webs Wd and We are turned into the center spreads that are both inserted between the sheets Wa and Wc but on the opposite sides of their centerline folds.

The three inside webs Wc, Wd and We may be rethreaded as indicated by the dashed lines in FIG. 15 for turning the webs Wc and We into additional center spreads. The preselected web Wc is shown directed to the prefolding means 7*b*, and the other preselected web We to the other prefolding means 7*a*. The unselected inside web Wd is shown guided directly to the superposing means 6 by the lead-in guide rollers 12*b* interposed between both prefolding means 7*a* and 7*b*.

Figure 16B:
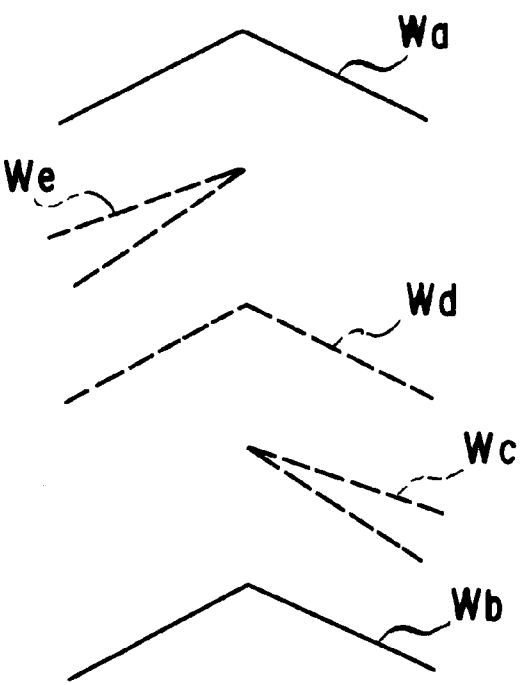

The resulting triple-center-spread signature configuration is as pictured in FIG. 16B. The preselected web Wc forms one additional center spread between the sheets Wb and Wd and on the righthand side, as viewed in this figure, of their centerline folds, and the other preselected web We another additional center spread between the sheets Wa and Wd and on the left-hand side of their centerline folds.

The alternating-dot-and-dash lines in FIG. 15 exhibit how the three inside webs Wc Wd and We are threaded when the webs Wc and Wd are preselected and directed to the prefolding means 7*a* and 7*b*. The remaining unselected inside web We is shown guided by the lead-in guide rollers 12*a* around both prefolding means 7*a* and 7*b*.

Figure 16C:
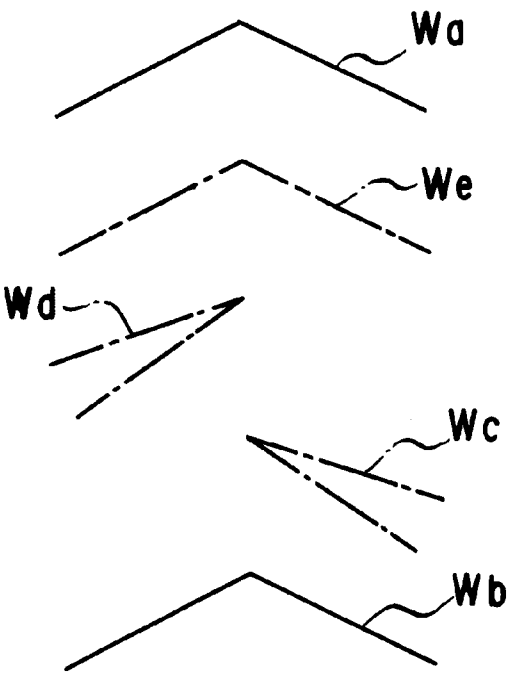

FIG. 16C shows the resulting triple-center-spread signature. The two additional center spreads Wc and Wd are both sandwiched between the sheets Wb and We but on the opposite sides of their centerline folds.

As an additional modification of this triple-center-spread machine, either of the two prefolding means 7*a* and 7*b* may be made pivotable 180 degrees about the tip of the former, as in FIGS. 6 and 7. Then the two additional center spreads will be created on either one, as in FIGS. 13A–13C, or both sides, as in FIGS. 16A–16C, of the centerline folds of the other sheets of each signature.

Fifth Form (FIGS. 17–20)

Figure 17:
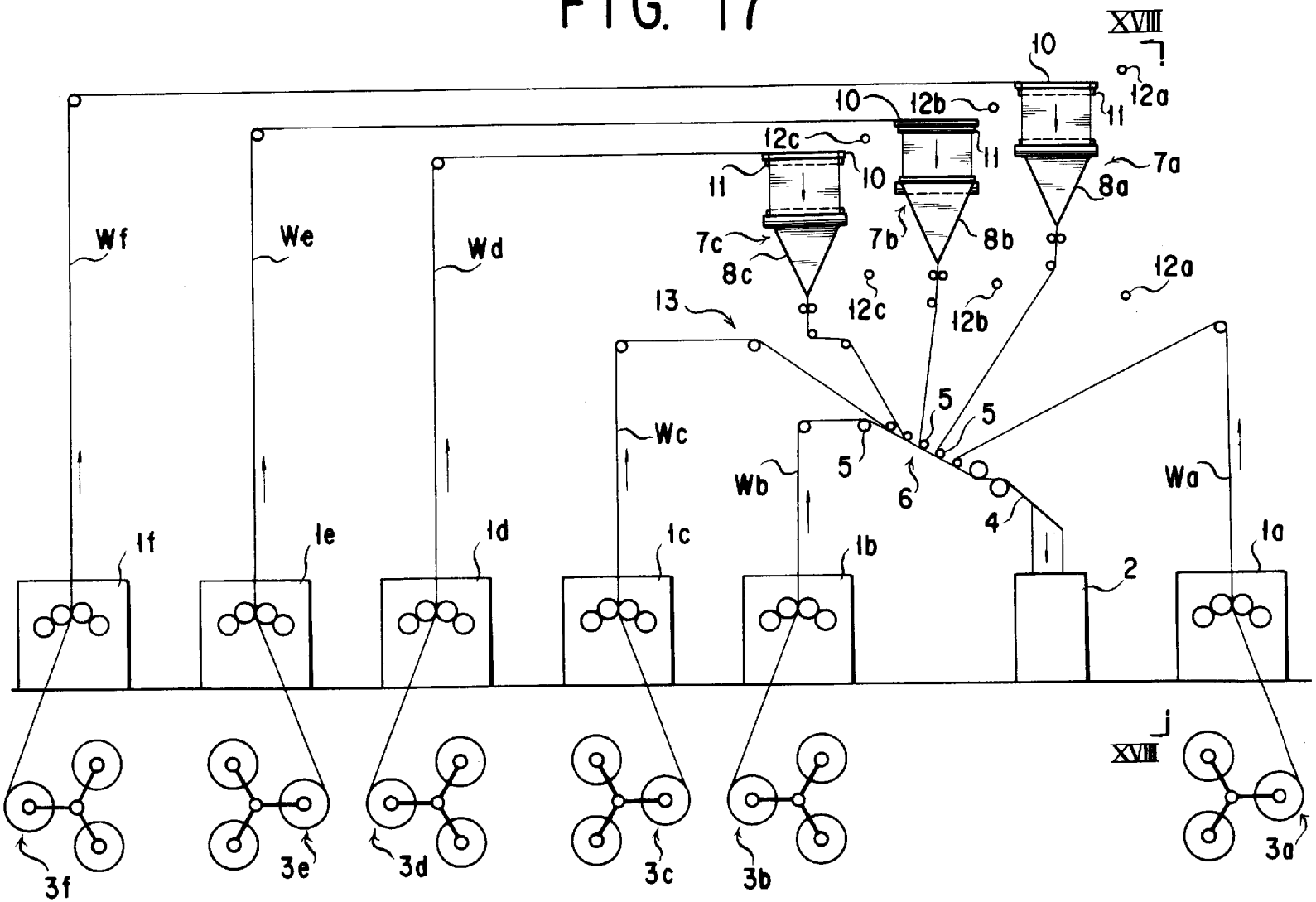
FIG. 17 is a view similar to FIG. 1 but showing a fifth preferred form of rotary printing press according to the invention, which is designed for production of quadruple-center-spread signatures, with two additional center spread on one side, and one additional center spread on the other side, of the centerline folds of each signature.
Figure 18:
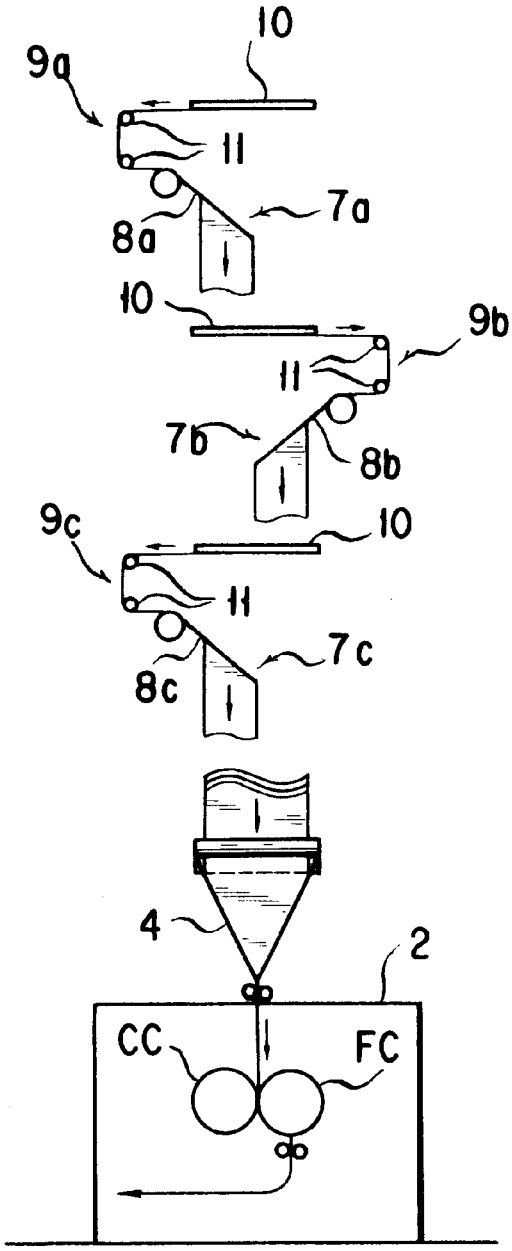
FIG. 18 is a section taken along the line XVII—XVII in FIG. 17 and looking in the direction of the arrows.

In FIGS. 17 and 18 is shown a printing press capable of printing on six webs and delivering them in quadruple-center-spread signatures, with two additional center spreads on one side, and one other additional center spread on the other side, of the centerline fold in each signature. The quadruple-center-spread machine has three prefolding means 7*a*, 7*b* and 7*c* positioned at both horizontal and vertical spacings from one another. The first or righthand prefolding means 7*a* and the second or left-hand prefolding means 7*c* are oriented in the same direction, and the intermediate former 7*b* is oriented in the opposite direction. The tips of the formers 8*a*, 8*b* and 8*c* of the three prefolding means 7*a*, 7*b* and 7*c* are all on the same vertical plane containing the aligned centerline of the unselected webs.

Figure 19:
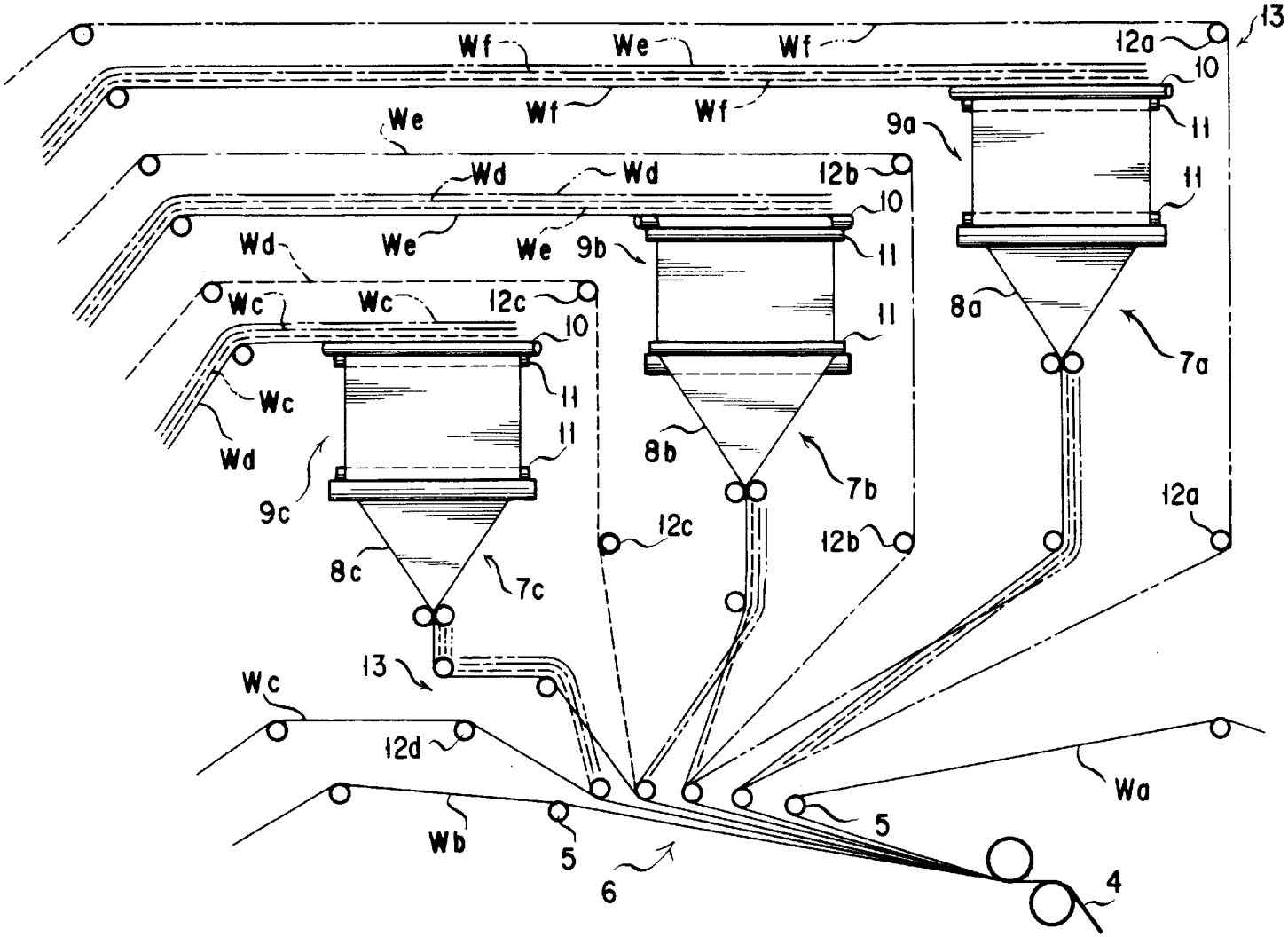
FIG. 19 is a view similar to FIG. 4 but explanatory of how the webs are threaded through the FIG. 17 machine to create three additional center spreads between desired pages on both sides of the centerline folds of each signature.

As will be noted from both FIGS. 17 and 19, lead-in guide rollers are provided at 12*a*, 12*b*, 12*c* and 12*d* for guiding unselected webs around the three prefolding means 7*a*–7*c*. The other details of construction are as previously described with reference to FIGS. 1–5.

Operation of Fifth Form

Any three of the four inside webs Wc, Wd, We and Wf may be preselected to provide three additional center spreads in each quadruple-center-spread signature desired. Both FIGS. 17 and 19 indicate by the solid lines how all the webs Wa–Wf are threaded through the machine in the case where Wd, We and Wf are preselected. The preselected web Wd is shown directed to the prefolding means 7*c*, the preselected web We to the prefolding means 7*b*, and the preselected web Wf to the prefolding means 7*a*. The unselected inside web Wc is shown guided directly to the superposing means 6 by the lead-in guide roller 12*d*.

Figures 20A, 20B, 20C, 20D:
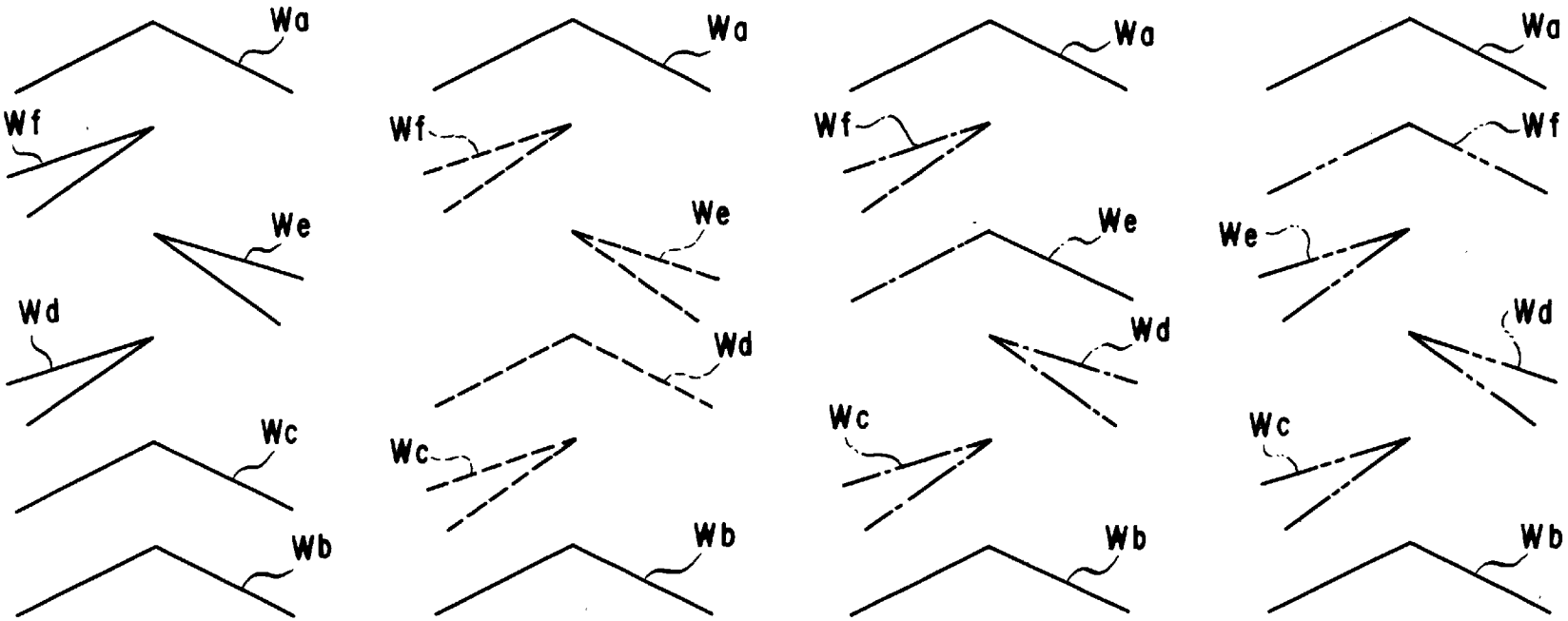
FIGS. 20A, 20B, 20C and 20D are diagrammatic illustrations of four different quadruple-center-spread signature configurations producible by the FIG. 17 printing press as the webs are threaded therethrough as indicated in FIG. 19.

FIG. 20A shows the resulting quadruple-center-spread signature configuration. The three preselected webs Wd, We and Wf are turned into center spreads between the sheets Wa and Wc, two on one side, and one on the other side, of the centerline folds of the unselected webs Wa, Wb and Wc.

The four inside webs Wc–Wf may be rethreaded as indicated by the dashed lines in FIG. 19 for turning the webs Wc, We and Wf into additional center spreads. The preselected web Wc is shown directed to the prefolding means 7*b*, the preselected web We to the prefolding means 7*b*, and the preselected web Wf to the prefolding means 7*a*. The unselected inside web Wd is shown guided directly to the superposing means 6 by the lead-in guide rollers 12*c* interposed between the prefolding means 7*b* and 7*c*.

The resulting quadruple-center-spread signature configuration is as pictured in FIG. 20B. The preselected web Wc forms one additional center spread between the sheets Wb and Wd, and the other two preselected web We and Wf two other additional center spreads between the sheets Wa and Wd. The center spreads Wc and Wf are on one side, and the center spread We on the other side, of the centerline folds of the sheets Wa, Wb and Wd.

The alternating-one-dot-and-dash lines in FIG. 19 demonstrate how the four inside webs Wc–Wf are threaded when the webs Wc, Wd and Wf are preselected as additional center spread webs. The preselected web Wc is shown directed to the prefolding means 7*c*, the preselected web Wd to the prefolding means 7*b*, and the preselected web Wf to the prefolding means 7*a*. The unselected inside web We is shown guided directly to the superposing means 6 by the lead-in guide rollers 12*b* positioned between the prefolding means 7*a* and 7*b*.

FIG. 20C shows the resulting quadruple-center-spread signature. The two additional center spreads Wc and Wd are sandwiched between the sheets Wb and We and on both sides of the centerline folds of these sheets. The other additional center spread Wf is inserted between the sheets Wa and We and on the same side of the centerline folds as is the center spread Wc.

The alternating-two-dots-and-dash lines in FIG. 19 demonstrate how the four inside webs Wc–Wf are threaded when the webs Wc, Wd and We are preselected as additional center spread webs. The preselected web Wc is shown directed to the prefolding means 7*c*, the preselected web Wd to the prefolding means 7*b*, and the preselected web We to the prefolding means 7*a*. The unselected inside web Wf is shown guided directly to the superposing means 6 by the lead-in guide rollers 12*a* positioned outside the prefolding means 7*a*.

As shown in FIG. 20D, the resulting quadruple-center-spread signature has three additional center spreads Wc, Wd and We all sandwiched between the sheets Wb and Wf. The center spreads Wc and We are on one side, and the center spread Wd on the other side, of the centerline folds of the sheets Wa, Wb and Wf.

Notwithstanding the foregoing detailed disclosure, it is not desired that the present invention be limited by the exact showing of the drawings or the description thereof. A variety of modifications and alterations of the illustrated embodiments may be made in order to conform to design preferences or to the requirements of each specific application.

For instance, in all the illustrated embodiments, greater numbers of printing units could be provided for printing on as many webs from as many web feeders. In such cases, of course, greater numbers of prefolding means might be incorporated for greater numbers of center spreads in each signature. It is also possible to adapt the illustrated machines for use with webs twice as wide as the longitudinal dimension of the signatures, when they are unfolded, to be produced, by incorporating means for longitudinally slitting such webs into halves after printing and means for superposing such web halves.

All these and other modifications or alterations are intended in the foregoing disclosure. It is therefore appropriate that the invention be construed broadly and in a manner consistent with the fair meaning or proper scope of the claims which follow.

What is claimed is:

1. A web-fed rotary printing press capable of producing signatures each having a predetermined number of pages including a plurality of center spreads, comprising:

(a) a plurality of printing units for printing on separate webs of paper or like printable material traveling in centerline alignment and in phase with one another;

(b) angle guide means for turning a preselected web, which has been printed in one of the printing units, 90 degrees out of phase with the other, unselected webs;

(c) at least one preselected web former disposed downstream of the angle guide means with respect to a traveling direction of the preselected web for folding the preselected web along a centerline thereof, back into phase with the unselected webs;

(d) means for superposing the preselected web, which has been folded by the preselected web former, and the unselected webs, which have bypassed the angle guide means and the preselected web former, one upon another, with the fold of the preselected web in register with the aligned centerline of the unselected webs;

(e) an unselected web former disposed downstream of the superposing means with respect to a traveling direction of the superposed webs and displaced 90 degrees out of phase with the preselected web former for folding the superposed webs along the aligned centerline of the unselected webs; and (f) means disposed downstream of the unselected web former for transversely cutting the folded webs into individual multiple-page signatures each having at least two center spreads.

2. The rotary printing press of claim 1 further comprising lead-in guide means for permitting any of the webs that have been printed by the printing units to be fed to the angle guide means as a preselected web and for guiding the unselected webs around the angle guide means and the preselected web former and directly to the superposing means, whereby at least one center spread can be placed between any desired pages on one side of centerline folds of each signature.

3. The rotary printing press of claim 1 wherein the angle guide means is angularly displaceable for turning the preselected web 90 degrees out of phase with the unselected webs in either of two opposite directions, and wherein the preselected web former is angularly displaceable for folding the preselected web along the centerline thereof regardless of which direction the preselected web has been turned in by the angle guide means, whereby at least one center spread can be placed on either side of centerline folds of each signature.

4. A web-fed rotary printing press capable of producing signatures each having a predetermined number of pages including a plurality of center spreads, comprising:

(a) a plurality of printing units for printing on separate webs of paper or like printable material traveling in centerline alignment and in phase with one another;

(b) at least two angle guide means each for turning one preselected web, which has been printed in one of the printing units, 90 degrees out of phase with unselected webs;

(c) at least two preselected web formers each disposed downstream of one angle guide means with respect to a traveling direction of one preselected web for folding one preselected web along a centerline thereof, back into phase with the unselected webs;

(d) means for superposing the preselected webs, which have been folded by the preselected web formers, and the unselected webs, which have bypassed the angle guide means and the preselected web formers, one upon another, with the folds of the preselected webs in register with the aligned centerline of the unselected webs;

(e) an unselected web former disposed downstream of the superposing means with respect to a traveling direction of the superposed webs and displaced 90 degrees out of phase with the preselected web formers for folding the superposed webs along the aligned centerline of the unselected webs; and (f) means disposed downstream of the unselected web former for transversely cutting the folded webs into individual multiple-page signatures each having at least three center spreads.

5. The rotary printing press of claim 4 wherein the two angle guide means and the two preselected web formers are oriented in the same direction, whereby two center spreads are created on the same side of centerline folds of each signature.

6. The rotary printing press of claim 5 further comprising lead-in guide means for permitting any two of the webs that have been printed by the printing units to be fed to the respective angle guide means as preselected webs and for guiding the unselected webs around the angle guide means and the preselected web formers and directly to the superposing means, whereby two center spreads can be placed between any desired pages, either consecutively or individually, on one side of centerline folds of each signature.

7. The rotary printing press of claim 4 wherein the two angle guide means and the two preselected web formers are oriented in opposite directions, whereby two center spreads are created on opposite sides of centerline folds of each signature.

8. The rotary printing press of claim 7 further comprising lead-in guide means for permitting any two of the webs that have been printed by the printing units to be fed to the respective angle guide means as preselected webs and for guiding the unselected webs around the angle guide means and the preselected web formers and directly to the superposing means, whereby two center spreads can be placed between any desired pages on opposite sides of centerline folds of each signature.

9. A web-fed rotary printing press capable of producing signatures each having a predetermined number of pages including a plurality of center spreads, comprising:

(a) a plurality of printing units for printing on separate webs of paper or like printable material traveling in centerline alignment and in phase with one another;

(b) first angle guide means for turning a first preselected web, which has been printed in one of the printing units, 90 degrees out of phase with unselected webs;

(c) second angle guide means for turning a second preselected web, which has been printed in another of the printing units, 90 degrees out of phase with unselected webs;

(d) third angle guide means for turning a third preselected web, which has been printed in still another of the printing units, 90 degrees out of phase with unselected webs;

(e) a first preselected web former disposed downstream of the first angle guide means with respect to a traveling direction of the first preselected web for folding the first preselected web along a centerline thereof, back into phase with the unselected webs;

(f) a second preselected web former disposed downstream of the second angle guide means with respect to a traveling direction of the second preselected web for folding the second preselected web along a centerline thereof, back into phase with the unselected webs;

(g) a third preselected web former disposed downstream of the third angle guide means with respect to a traveling direction of the third preselected web for folding the third preselected web along a centerline thereof, back into phase with the unselected webs;

(h) means for superposing the first to third preselected webs, which have been folded by the first to third preselected web formers, and the unselected webs, which have bypassed all the angle guide means and all the preselected web formers, one upon another, with the folds of the preselected webs in register with the aligned centerline of the unselected webs;

(i) an unselected web former disposed downstream of the superposing means with respect to a traveling direction of the superposed webs and displaced 90 degrees out of phase with each preselected web former for folding the superposed webs along the aligned centerline of the unselected webs; and (j) means disposed downstream of the unselected web former for transversely cutting the folded webs into individual multiple-page signatures each having at least four center spreads;

(k) at least one of the three angle guide means and at least one of the three preselected web formers are oriented in a direction opposite to the orientation of the other angle guide means and the other preselected web formers, whereby at least one center spread is created on one side, and two other center spreads on the other side, of centerline folds of each signature.

10. The rotary printing press of claim 9 further comprising lead-in guide means for permitting any three of the webs that have been printed by the printing units to be fed interchangeably to the three angle guide means as preselected webs and for guiding the unselected webs around the angle guide means and the preselected web formers and directly to the superposing means, whereby two center spreads can be placed between any desired pages, either consecutively or individually, on one side of the centerline folds of each signature, and one other center spread between any desired pages on the other side of the centerline folds of each signature.

* * * * *